US008071049B2

(12) United States Patent
Koltay et al.

(10) Patent No.: US 8,071,049 B2
(45) Date of Patent: Dec. 6, 2011

(54) PIPETTE TIP, PIPETTING DEVICE, PIPETTE TIP ACTUATING DEVICE AND METHOD FOR PIPETTING IN THE NL RANGE

(75) Inventors: Peter Koltay, March (DE); Wolfgang Streule, Waldkirch (DE)

(73) Assignees: Roland Zengerle, Waldkirch (DE); Hermann Sandmaier, Obereschach (DE)

( * ) Notice: Subject to any disclaimer, the term of this patent is extended or adjusted under 35 U.S.C. 154(b) by 1674 days.

(21) Appl. No.: 11/351,910

(22) Filed: Feb. 10, 2006

(65) Prior Publication Data

US 2006/0171854 A1 Aug. 3, 2006

Related U.S. Application Data

(63) Continuation of application No. PCT/EP2005/013671, filed on Dec. 19, 2005.

(30) Foreign Application Priority Data

Dec. 19, 2005 (DE) ..... 10 2005 002 525

(51) Int. Cl.
*B01L 3/02* (2006.01)
*B01L 5/00* (2006.01)

(52) U.S. Cl. ..... 422/501; 422/68.1; 436/148; 219/385; 219/386

(58) Field of Classification Search ..... 422/100, 422/68.1, 501; 436/148; 219/386, 385
See application file for complete search history.

(56) References Cited

U.S. PATENT DOCUMENTS

| | | | | |
|---|---|---|---|---|
| 3,650,699 | A | 3/1972 | Beer | |
| 4,418,580 | A * | 12/1983 | Satchell et al. | 73/864.13 |
| 5,032,343 | A * | 7/1991 | Jeffs et al. | 264/320 |
| 5,336,468 | A * | 8/1994 | Tezuka et al. | 422/100 |
| 5,406,856 | A * | 4/1995 | Kuhn | 73/864.14 |
| 5,947,167 | A | 9/1999 | Bogen et al. | |
| 6,032,343 | A | 3/2000 | Blanch et al. | |
| 6,180,061 | B1 * | 1/2001 | Bogen et al. | 422/64 |
| 6,280,148 | B1 | 8/2001 | Zengerle et al. | |
| 6,416,294 | B1 | 7/2002 | Zengerle et al. | |

(Continued)

FOREIGN PATENT DOCUMENTS

DE 2 120 719 12/1971

(Continued)

OTHER PUBLICATIONS

Merriam-Webster Dictionary Online: http://www.merriam-webster.com.*

*Primary Examiner* — Krishnan S Menon
*Assistant Examiner* — Rebecca M Fritchman
(74) *Attorney, Agent, or Firm* — Laurence A. Greenberg; Werner H. Stemer; Ralph E. Locher

(57) ABSTRACT

A changeable pipette tip includes a first end having a fluid opening and a second end having a pipe elastic in the radial direction having an orifice. The orifice and the fluid opening are in fluid connection. The first end is designed to be coupled to a matching coupling unit of a pipetting unit such that liquid may be sucked into the fluid area through the orifice by an actuating unit in the pipetting unit. In order to eject liquid as free-flying droplets or as a jet from the orifice of the pipe elastic in the radial direction, a volume change of a portion of the pipe elastic in the radial direction is effected.

12 Claims, 9 Drawing Sheets

U.S. PATENT DOCUMENTS

| | | | |
|---|---|---|---|
| 6,431,015 | B1 | 8/2002 | Hodac et al. |
| 6,599,755 | B1 | 7/2003 | Eipel et al. |
| 6,855,293 | B1 | 2/2005 | Zengerle et al. |

FOREIGN PATENT DOCUMENTS

| | | | |
|---|---|---|---|
| DE | 41 41 608 | A1 | 6/1993 |
| DE | 43 14 343 | A1 | 11/1994 |
| DE | 198 02 38 | C1 | 8/1999 |
| DE | 198 02 367 | C1 | 9/1999 |
| DE | 199 13 076 | A1 | 10/2000 |
| EP | 0 028 478 | | 5/1981 |
| EP | 1 072 313 | A2 | 1/2001 |
| EP | 1 093 856 | A1 | 4/2001 |
| GB | 2 353 093 | A | 2/2001 |
| WO | WO 00/45955 | | 8/2000 |
| WO | WO 02/092228 | A2 | 11/2002 |
| WO | WO 2004/099059 | A2 | 11/2004 |
| WO | WO 2004/106070 | A2 | 12/2004 |

* cited by examiner

PIPETTE TIP, PIPETTING DEVICE, PIPETTE TIP ACTUATING DEVICE AND METHOD FOR PIPETTING IN THE NL RANGE

CROSS-REFERENCE TO THE RELATED APPLICATION

This is a continuation, under 35 U.S.C. §120, of copending international application No. PCT/EP2005/013671, filed on Dec. 19, 2005, which designated the United States; this application also claims the priority, under 35 U.S.C. §119, of German patent application No. DE 10 2005 002 525.0, filed Jan. 19, 2005; the prior applications are herewith incorporated by reference in their entirety.

BACKGROUND OF THE INVENTION

1. Field of the Invention

The present invention relates to a changeable pipette tip, a pipetting device, a pipette tip actuating device and a method for pipetting which allow to take in liquid and to eject liquid volumes in the nanoliter range.

2. Description of the Related Art

According to prior art, pipetting methods with changeable tips only allow to dose volumes in the range of some microliters ($10^{-9}$ $m^3$) to milliliters ($10^{-6}$ $m^3$).

A typical hand pipette 10 with a changeable pipette tip 12 is illustrated in FIG. 5. The hand pipette 10 includes a coupling means 14 onto which the rear part of the pipette tip 12 may be plugged so that there is a fluid connection of the internal fluid areas of the pipette tip with internal fluid areas of the hand pipette 10 via the fluid opening 16. The hand pipette 10 includes means (not shown) for generating a negative pressure and/or a positive pressure in its internal fluid areas so that liquid may be sucked into the pipette tip and/or ejected therefrom through an orifice opening 18 in the pipette tip 12.

Automatic pipetting devices generally provide a moveable mount 20 (FIG. 6) comprising coupling means 22 for receiving one or more pipette tips 24. Here, the pipette tips 24 are connected to the pipetting means comprising the moveable mount 20 such that liquid is sucked in and/or ejected through the orifice openings of the pipette tips 24 by corresponding actuating means in the pipetting means. For this purpose, fluid areas in the pipette tip are generally in fluid connection with fluid areas in the pipetting means.

In such automatic pipetting devices, the pipette tip 24 is taken from a carrier and clamped into the moveable mount 20. For aspirating, the orifice opening of the pipette tip is then immersed in a vessel. After the liquid has been taken in, which is achieved by means of negative pressure in the pipette, the pipette tip is moved over the target where then, by means of a positive pressure in the pipette, either its whole contents or a small part thereof is released into the target vessel. In the case of large volumes, this may be done in a free jet, in the case of small volumes there may have to be a contact between target and pipette tip since there will be no drop break due to adhesion forces at the pipette tip.

On the one hand, the above process limits the minimum volume to be released, on the other hand, there may also occur a carry-over of substances already present in the target. Once the dosing is completed, the pipette tip is released into a waste box by means of an automatic ejection mechanism. In the example shown in FIG. 6, the automatic pipetting device, as it is used by the company Eppendorf, for example, includes coupling means for eight pipette tips.

For the release of liquid volumes of less than one microliter, the prior art knows free jet methods, as described in DE 19802367 C1 and DE 19802368 C1. There, a pressure chamber is respectively bounded by a membrane on one side, so that liquid droplets may be ejected from an ejection opening fluidically connected to the pressure chamber by deflecting the membrane.

A method allowing to release liquid amounts in the range of some 10 nanoliters is known as so-called "mosquito" method by the company TP Labtech, wherein here, however, the part to be exchanged in fluid contact involves a lot of manufacturing effort and is correspondingly expensive. Other systems, such as one described in EP 1093856 A1, are based on adapted pipettes into which a membrane is inserted. By means of an actuator pushing it, it allows higher dynamics than air cushion pipettes, whereby smaller release amounts may be achieved.

Finally, a method for dosing liquids in the nanoliter range is known from the German application 10337484.1, which was not prepublished. Such a method is schematically shown in FIGS. 7*a* to 7*c*. As shown in FIG. 7*a*, a flexible tube 30 includes an end 32 on the inlet side serving for the connection to a liquid reservoir, and an end 34 on the outlet side at which micro drops and/or micro jets may be released. Respective walls 36 of the elastic tube 30 are illustrated by dashed lines. An actuating means 38 is provided in the form of a displacer, which comprises a connecting part 40 with which the displacer 38 may be attached to an actuating member for driving the displacer 38.

The elastic tube may, for example, have a substantially constant cross-section, which will generally be circular, from its inlet end 32 to its outlet end 34. An area 42 arranged below the displacer 38 may be referred to as dosing chamber area and is defined by the position of the displacer with respect to the elastic tube. An area 44 essentially starting at the right end of the displacer 38 represents an outlet channel, while an area 46 essentially starting at the left end of the displacer 38 represents an inlet channel. The displacer 38 may comprise a displacer surface 50 extending in an inclined way with respect to the wall 36 of the flexible tube 30, which, during operation of the micro dosing device, allows the generation of a preferred direction in the direction of the outlet opening 34.

Assume that, in the state shown in FIG. 7*a*, the flexible tube 30 is filled with a liquid, wherein such a filling may be done, for example, by capillary forces. Starting from this state, the displacer 38 is moved quickly downwards in the direction of the arrows 52, so that a reduction of the duct volume between inlet opening and outlet opening is caused. This results in a liquid flow 54 towards the outlet end 34 and a liquid flow 56 towards the inlet end 32. Due to the forward flow 54, there is a liquid ejection in the form of a micro drop 60 and/or micro jet at the outlet opening 34. The portion of the liquid released through the outlet opening 34 as jet and/or drop depends on the position, type and dynamics of the volume change. Furthermore, the amount of liquid released as drop depends on the size of the displacer and on the stroke of the displacer 38, i.e. how much the tube is compressed.

After the ejection process, there is a refilling phase in which the displacer 38 is moved away from the tube in the direction of arrow 61 so that the volume of the inlet opening 32 and the outlet opening 34 is increased again and thus liquid flows through the inlet channel 46, see arrow 64 in FIG. 7*c*.

The details regarding this dosing method are described, as mentioned above, in the German application 10337484, whose related disclosure is incorporated by reference.

U.S. Pat. No. 5,032,343 discusses a micro pipette tip for locations that are hard to reach. For this purpose, the front portion of the micro pipette tip is extended and ultra thin. This causes flexibility allowing the placement of the pipette tip at locations that are hard to reach. The opposing end of the pipette tip is rigid and allows to attach the pipette tip to conventional tools.

U.S. Pat. No. 6,180,061 discusses a cartridge pump and dispensing arrangement for applications in which cartridges containing liquid reagents are changed frequently. The cartridge pump includes a reservoir in which there is arranged a moveable piston. A lower open end of the reservoir empties directly into a dosing chamber in the form of a flexible pipe line. An actuating means in the form of a rubber mallet is provided by which the volume of the dosing chamber may be reduced to thereby cause an outflow of liquid through a nozzle connected to an end of the dosing chamber on the ejection side. Two valves are further arranged in the dosing chamber which allow only a unidirectional flow from the end on the reservoir side to the end on the nozzle side of the dosing chamber.

WO 02/092228 A2 discusses a dispensing means in which a conventional syringe pump is used to eject liquid volumes of less than 5 μl. According to this document, there is provided a syringe pump that is connected to a dispenser 2 via a tube line. The dispenser includes a system liquid reservoir separated from a sample liquid reservoir by an elastomer membrane. A nozzle comprising a nozzle bore is connected to the sample liquid reservoir. The system liquid reservoir is connected to the syringe pump via the tube line so that, by actuating the syringe pump, the membrane may be deflected via the system liquid to thereby eject sample liquid through the nozzle. Sample liquid may also be sucked in through the nozzle, wherein, in order to disconnect a droplet hanging at the nozzle after sucking in the sample liquid, an electric field is applied between the nozzle and a suitably arranged counterelectrode. One embodiment alternatively provides an actuating means to cause an axial expansion and/or compression of the nozzle to thereby disconnect droplets adhering to the tip after the sucking.

EP 0028478 B1 discusses a pipetting means in which an elastic pipe line is housed in a block such that a pipe-shaped recess in the block has a larger diameter than the outer diameter of the elastic pipe line. An end of the elastic pipe line on the ejection side is connected to a connection piece which, in turn, is connected to a pipette tip. Sucking in and ejecting liquid through the pipette tip is done by applying a positive pressure or a negative pressure to the internal bore of the block to cause corresponding volume changes of the elastic pipe line. In one embodiment, an end of the described squeeze tube means spaced apart from the pipette tip is connectable to a syringe via a three-way valve so that sample liquid and a diluting agent that was drawn into the syringe beforehand may be ejected into an outflow vessel through the pipette tip by actuating the syringe and by pressurizing the internal bore of the block.

SUMMARY OF THE INVENTION

It is the object of the present invention to provide a pipette tip, a micro pipetting device, a pipette tip actuating device and a method for pipetting allowing the release of small amounts of liquid.

In accordance with a first aspect, the present invention provides a changeable pipette tip having a first end having a fluid opening; and a second end having a pipe elastic in the radial direction having an orifice, wherein the elastic pipe is designed such that it behaves substantially rigid with respect to bending along the pipe axis, but flexible and elastic with respect to radial deformations, wherein the orifice and the fluid opening are in fluid connection, and wherein the first end is designed to be coupled to a matching coupling unit of a pipetting unit such that liquid may be sucked into the fluid area through the orifice by an actuating unit in the pipetting unit.

In accordance with a second aspect, the present invention further provides a pipetting device having a coupling unit for coupling to a pipette tip having a first end with a fluid opening and a second end having a pipe elastic in the radial direction with an orifice, wherein the orifice and the fluid opening are in fluid connection, and wherein the first end is designed to be coupled to the coupling unit; a first actuating unit for generating a negative pressure at the fluid opening at the first end of the pipette tip to suck in liquid through the orifice of the pipe elastic in the radial direction; and a second actuating unit for changing the volume of a portion of the pipe elastic in the radial direction in time to thereby eject liquid as droplets or as a free-flying jet from the orifice of the pipe elastic in the radial direction.

In accordance with a third aspect, the present invention further provides a pipette tip actuating device for a pipetting device having a pipette tip having a first end with a fluid opening and a second end, wherein the second end has a pipe elastic in the radial direction having an orifice, wherein the fluid opening and the orifice are in fluid connection, having a fixing unit having a first state in which the pipe elastic in the radial direction is fixed in a predetermined position, and a second state in which the pipe elastic in the radial direction is not fixed; a fixing unit driver for changing the state of the fixing unit; and an actuating unit for changing the volume of a portion of the pipe elastic in the radial direction in time to thereby eject liquid as droplets or as a free-flying jet from the orifice of the pipe elastic in the radial direction, when the fixing unit is in the first state.

In accordance with a fourth aspect, the present invention further provides a method for pipetting liquid using a pipette tip having a first end having a fluid opening and a second end, wherein the second end has a pipe elastic in the radial direction having an orifice, wherein the fluid opening and the orifice are in fluid connection, the method having the steps of filling the pipette tip by immersing the orifice of the pipe elastic in the radial direction into a liquid and generating a negative pressure at the fluid opening of the first end of the pipette tip; and causing a volume change of a portion of the pipe elastic in the radial direction to eject liquid as free-flying droplets or as a jet from the orifice of the pipe elastic in the radial direction by the volume change.

The present invention is based on the finding that a pipette tip both representing a low-cost exchange member and allowing the dosing of very small liquid volumes may be implemented by providing it with a flexible tube comprising an orifice end serving for liquid ejection and for liquid intake.

A pipe elastic in the radial direction is to be understood as one that is flexible and elastic with respect to radial deformations. For example, the pipe elastic in the radial direction may be formed by an elastic tube, i.e. a fluid duct that may also be flexible with respect to bending along the pipe axis, i.e. in the axial direction. For lengths typically used in a micro dosing device, such elastic tubes, however, behave more like a pipe, i.e. essentially rigid with respect to bending along the tube axis, but flexible and elastic with respect to radial deformations.

Typical materials for the pipe elastic in the radial direction and/or the elastic tube include polyimide, polyamide or silicone. Typical diameters may be from 0.1 to 1 mm. The pipe elastic in the radial direction may be mounted to the pipette tip body, for example, by gluing, injecting, shrinking or by press-fitting. The pipe elastic in the radial direction may further comprise arbitrarily shaped, for example round or angular, constant or changing cross-sections.

The present invention includes devices and a method that may be integrated into conventional automatic pipetting devices and offer the possibility to release volumes in the range from 0.1 nL to some μL. Preferably, the present invention further allows intermediate storage of the fluid in the pipette tip.

Instead of conventional pipette tips, the invention uses an arrangement of a rigid part that may have the structure of a conventional pipette tip, and an elastic tube. The rigid part allows the reception of the pipette tip in the automatic pipetting device and allows the ejection by means of conventional devices installed in the automatic device. Alternatively, the rigid part may allow the reception in a hand pipette. The tube attached to the bottom of the pipette serves for the release of the fluid situated in the pipette tip according to the method as described above with respect to FIGS. 7*a* to 7*c* and as discussed in the German application 10337484. The dosing volume released in a contact-free way may be in the range from 0.1 nL to 100 nL per individual dosing process. A higher dosing volume may be achieved by multiple dosing, wherein there may be achieved flow rates of up to 20 μL/s.

The inventive micro pipette may be used with conventional automatic pipetting devices, for example air cushion pipettes or syringe pumps, which are capable of using conventional one-way pipette tips. Instead of the conventional one-way pipette tips, there are used the inventive pipette tips. Through them, liquid may be drawn into the inventive pipette tip by the conventional pipetting mechanism. The liquid taken in may then be released again in various ways. Dosing may be done by the conventional pipetting mechanism to eject large volumes. Such a conventional pipetting mechanism is generally a pressure generating means capable of generating a negative pressure and/or a positive pressure in a pressure chamber in fluid connection with the interior of the pipette tip to cause sucking in and/or ejecting of liquid into and/or at the pipette tip.

However, in preferred embodiments of the present invention, the dosing is done according to the method described above with respect to FIGS. 7*a* to 7*c*. In preferred embodiments, the dosing tube is fixed using a fixing means, whereupon a volume displacement is caused in the tube and the dosing process is triggered thereby.

The inventive changeable pipette tip and/or one-way pipette tip may be handled, i.e. taken up and put down, automatically by a pipetting device like conventional pipette tips.

Using the inventive pipette tip, a liquid may be sucked in at a first position, wherein the pipette tip is then moved to a second position by the automatic pipetting device, where the dosing takes place. Alternatively, the pipette tip may also be removed from the automatic pipetting device after sucking in the liquid, wherein the dosing may be done at another place after the removal using a suitable actuating means for squeezing the tube.

The present invention thus provides a novel pipette tip consisting of an arrangement of a rigid pipette tip part and a flexible tube. Such a pipette tip may automatically be received in an actuating device for squeezing the elastic tube to thereby cause liquid ejection. Preferably, a fixing means is provided to automatically clamp the tube in the actuating means, whereupon the actuating member is moved in the actuating means to squeeze the tube to reduce its volume to cause liquid ejection. Such an actuating means may be used combined with a conventional automatic pipetting device so that liquid may be released from a pipette tip using the tube squeezing method, which may also be used for conventional pipetting, such as according to the air cushion principle.

The dimensions of the elastic tube may be such that a liquid may be intermediately stored in the pipette tip. In this respect, the dimensions of the tube and the orifice of the same may be so that liquid is retained in the tube by capillary forces and surface forces.

The present invention further allows the use of various driving units for aspirating and for dosing. The aspirating may be done, for example, by a conventional automatic pipetting device generating a negative pressure at the first end of the pipette tip. However, the aspirating may also be done driven only by capillary forces. Aspirating driven by capillary forces is described, for example, in GB 2353093 A. The dispensing may be done by an actuating means for generating a volume change of a pipe elastic in the radial direction, or may be caused by positive pressure or inertial forces, such as disclosed in GB 2353093 A or DE 19913076 A.

BRIEF DESCRIPTION OF THE DRAWINGS

Preferred embodiments of the present invention will be explained in more detail below with respect to the accompanying drawings, in which.

DESCRIPTION OF THE PREFERRED EMBODIMENTS

Figure 1A:
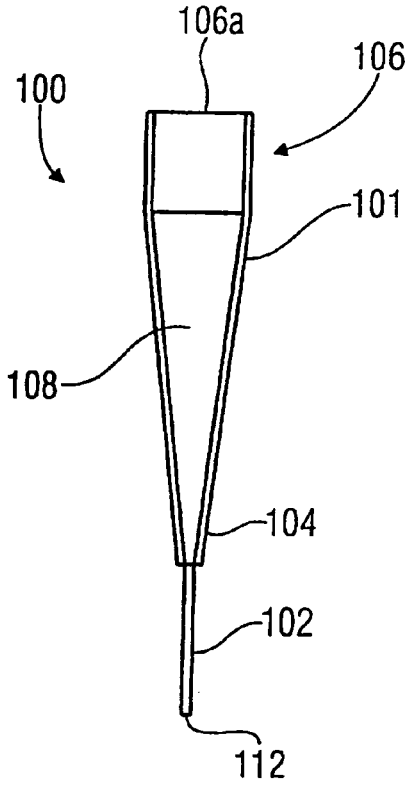
FIGS. 1*a* and 1*b* schematically show a cross-section and a full view of an inventive pipette tip.
Figure 1B:
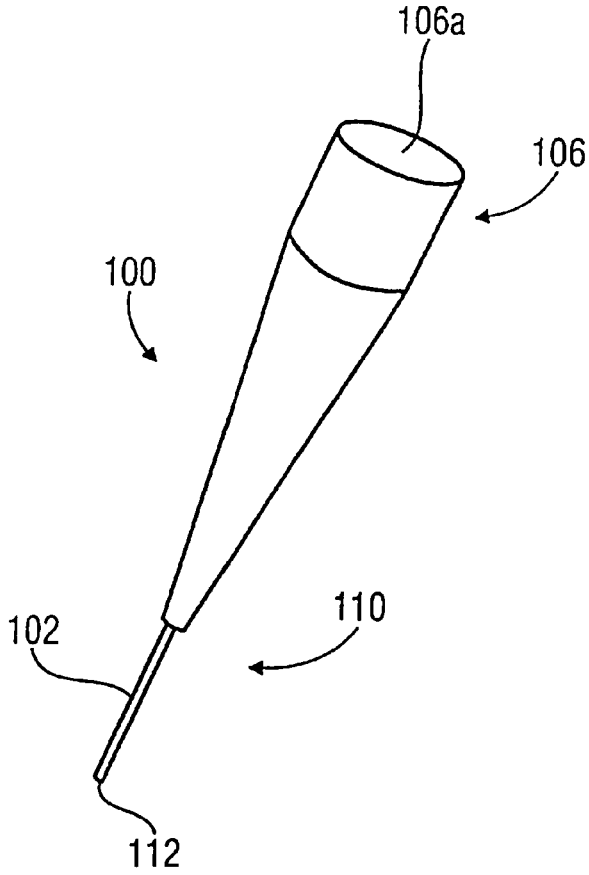

Schematic representations of an embodiment of an inventive pipette tip 100 are shown in FIGS. 1*a* and 1*b*. The pipette tip 100 includes a rigid pipette tip body 101 and an elastic tube 102 attached to a portion 104 on the pipette tip body 101. The pipette tip 100 includes a first end 106 formed by the rigid pipette tip body 101 and adapted to be mounted removably onto an automatic pipetting device or a hand pipette. The first end 106 includes a fluid opening 106*a* fluidically connected to a fluid chamber 108 in the micro pipette. The interior of the tube 102 is also fluidically connected to the fluid chamber 108. The elastic tube is arranged at a second end 110 of the pipette tip and comprises an orifice or fluid opening 112 through which liquid may enter or leave.

The pipette tip body 101 may consist of the same material as conventional pipette tips, while the elastic tube 102 is preferably formed of an elastically deformable polymer material. Elastic tube or pipe means a fluid duct that recovers the original shape after deformation, e.g. by squeezing, due to the elasticity of its material. The dimensions of the tube are preferably so that liquid may be retained in the pipette tip by the capillary effect therein and the surface tension at the orifice opening 112, so that the liquid may be intermediately stored in the pipette tip.

Figure 2:
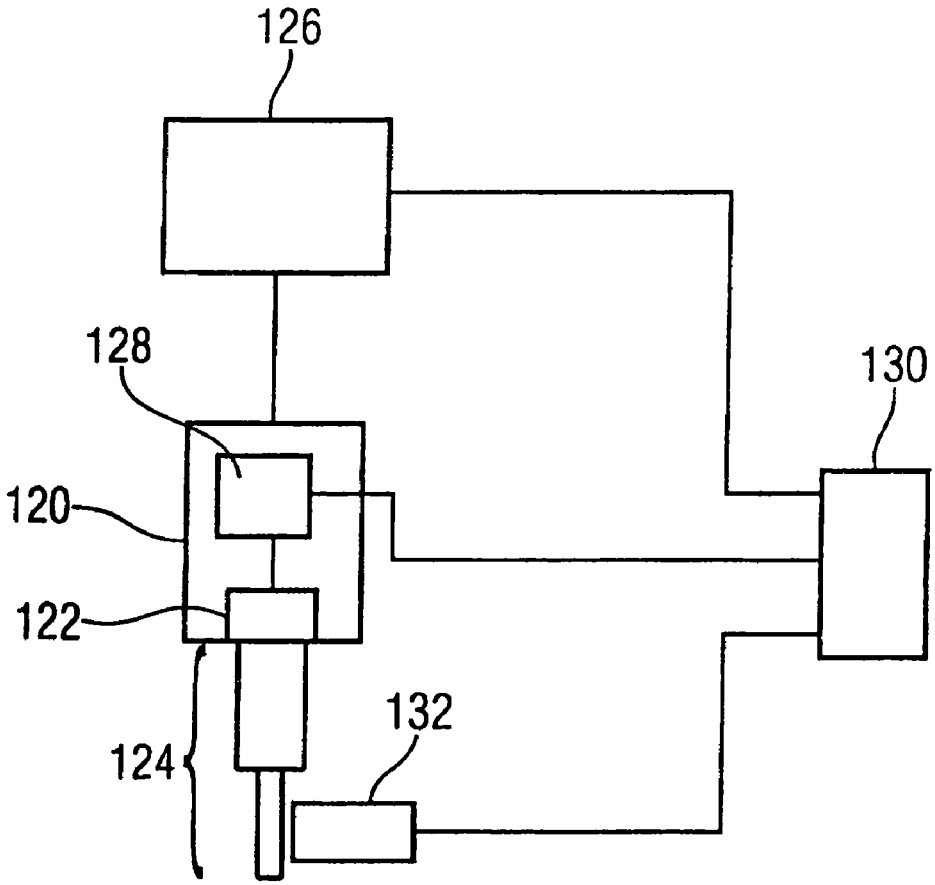
FIG. 2 is a schematic representation of an embodiment of an inventive pipetting device.

A schematic representation of an embodiment of an inventive pipetting means is shown in FIG. 2. The pipetting means includes a pipetting unit 120 comprising a coupling means 122 to which a pipette tip 100, for example one as explained above with respect to FIGS. 1*a* and 1*b*, may be replaceably attached. The pipetting unit may, for example, be structured comparable to the moveable mount of a conventional automatic pipetting device. A positioning means 126 is provided by which the pipetting unit 120 with the pipette tip 100 attached thereto may be moved between various operating positions. The pipetting unit further comprises a pressure generating means 128 to generate a negative pressure in the fluid chamber of the pipette tip 100 to thereby suck liquid into the pipette tip 100 through the orifice 112. Furthermore, the pressure generating means may also be designed such that the pipette tip may be provided with positive pressure, if necessary, for example to eject liquid driven by pressure in the conventional method of air cushion pipettes. A controller 130 is provided and connected to the positioning means 126 and the pressure generating means 128 to control operation of the same.

Furthermore, the inventive pipetting device does not only comprise the pressure generating means, but also an actuating means and/or driving means 132 to eject liquid from the elastic tube of the pipette tip 100. The controller 130 is also connected to the actuating means 132 to control its operation.

A complete pipetting cycle using a pipetting device as described above with respect to FIG. 2 may take place, for example, as follows.

First, the pipette tip 100 is received from a carrier using the pipetting unit 120 and particularly the coupling means 122. Such a reception may take place according to conventional receiving methods provided by conventional automatic pipetting devices. After the reception of the pipette tip, the pipetting unit 120 is moved using the positioning means 126 to immerse the elastic tube of the pipette tip into the liquid. By means of negative pressure provided by the pressure generating means 128 as in conventional automatic pipetting devices, the liquid is drawn into the pipette tip through the tube. After the completion of the aspirating process, the dosing unit, together with the pipette tip, is moved to the release site by the positioning means 126, i.e. to the position where the elastic tube may be actuated by the actuating means 132. Subsequently, the actuating means 132 is actuated to squeeze the elastic tube to once or several times eject liquid as droplets or as a free-flying jet from the orifice of the elastic tube. The tube and the actuating means are preferably designed to eject a dosing of liquid volumes in the nanoliter range, for example between 0.1 and 100 nL per dosing process. There may also take place several dosing processes to different targets and/or into different vessels from the same pipette tip. After completing the dosing processes in the nanoliter range, a liquid volume that may have remained in the pipette tip may be ejected driven by pressure with the conventional method of air cushion pipettes to completely empty the pipette tip and maybe retrieve valuable liquid.

After completing the dosing process and/or the dosing processes, the dosing unit may be moved to a storage container using the positioning means 126, where the pipette tip is disconnected from the pipetting unit and the coupling unit 122 using an ejection mechanism that may correspond to that of conventional automatic pipetting devices, and is put into the storage container.

As is apparent to someone skilled in the art, the positioning means may appropriately contain driving mechanisms, which may include motors and gears, to be able to effect the desired movements of the dosing unit 120. The controller 130 may be designed in any suitable way, for example using a micro processor, to control the positioning means 126, the pressure generating means 128 and the actuating means 132.

An exemplary embodiment of the actuating means 132 will be explained in more detail in the following with respect to FIGS. 3 and 4.

Figure 3A:
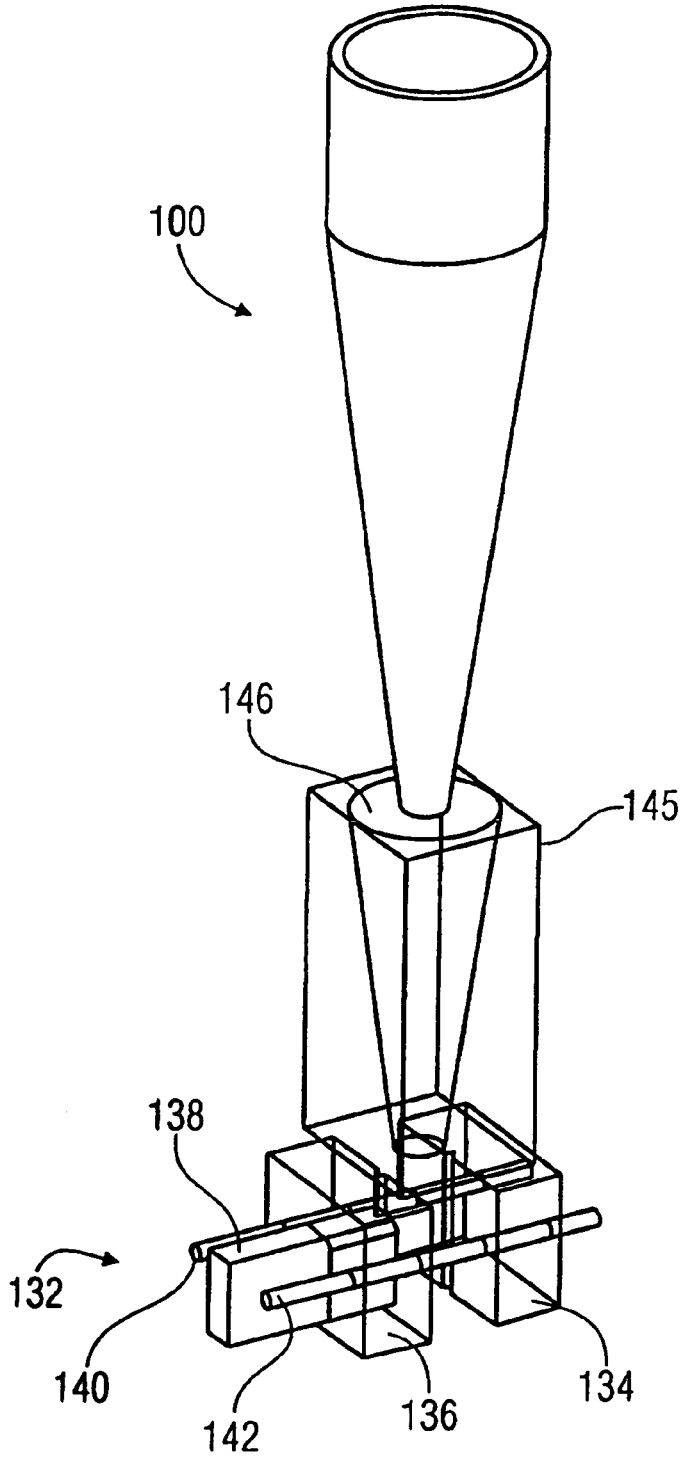
FIGS. 3*a* and 3*b* are schematic representations of a pipette tip with an actuating means for dosing.
Figure 3B:
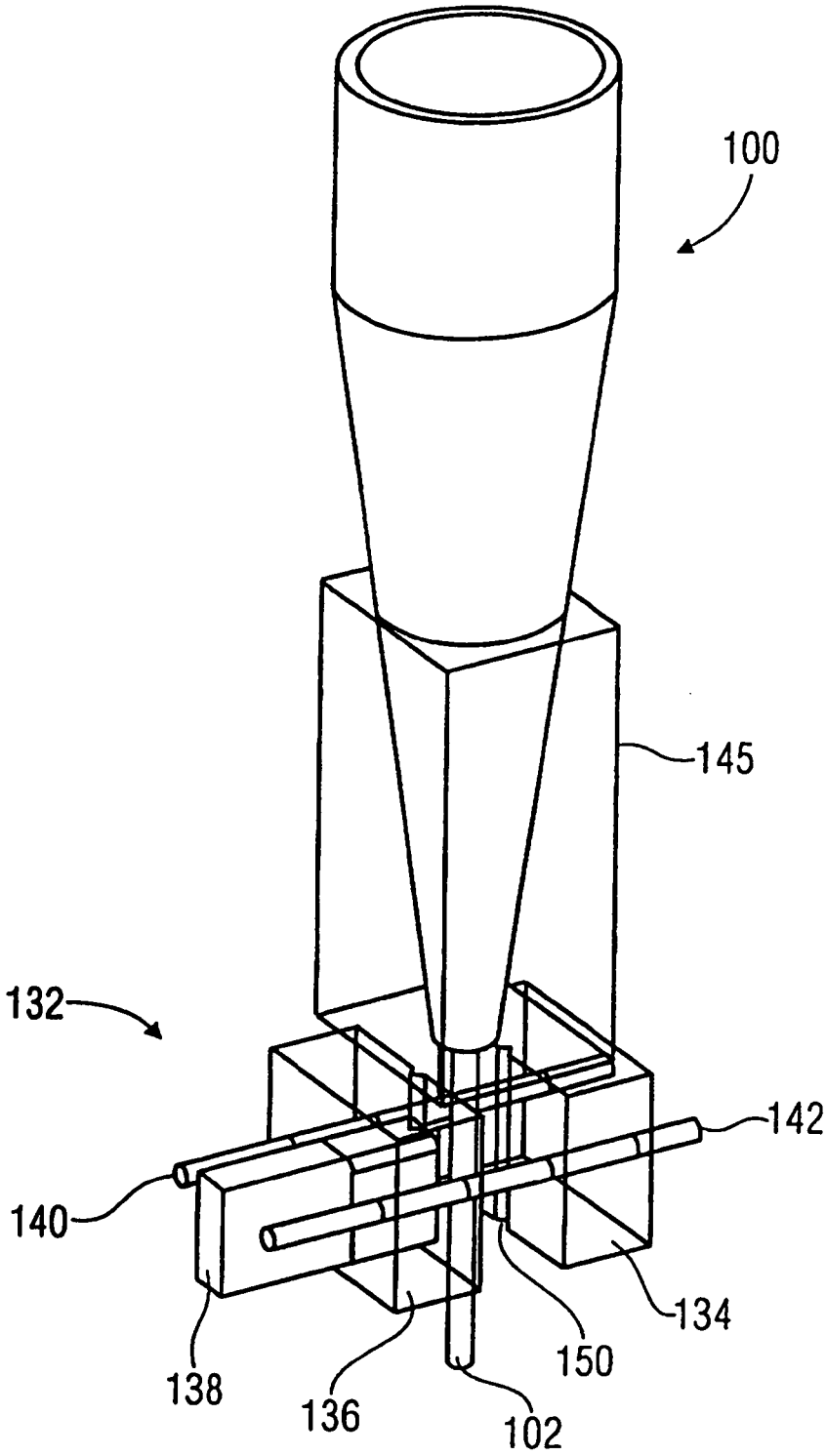

For reasons of clarity, FIGS. 3*a* and 3*b* only show the pipette tip 100 and the portions of the actuating means 132 necessary for the explanation. Furthermore, respective elements are illustrated at least partially transparent in FIGS. 3*a* and 3*b* to simplify the explanation.

As is to be seen from FIGS. 3*a*, 3*b* and 4*a* to 4*c*, the actuating means includes a first clamping jaw 134, a second clamping jaw 136 and an actuating member 138. The clamping jaws 134 and 136 are positioned on running rails 140, 142, wherein a suitable driving mechanism 143 (schematically illustrated in FIG. 4*b*) is provided to move the clamping jaws 134, 136 relative to each other along the running rails 140, 142. For the actuating member 138, which may also be referred to as ram or actuator, there is also provided a suitable driving mechanism 144 (FIG. 4*b*) by which the actuating member 138 may be moved substantially in parallel to the running rails 140 and 142. Furthermore, an auxiliary centering means 145 is provided in the shown embodiment that facilitates a centering of the pipette tip 100 relative to the actuating means 132. The auxiliary centering means 145 includes a block in which a recess 146 is formed whose shape is adapted to the outer contours of the pipette tip body 101. By inserting the pipette tip, as shown in FIG. 3*a*, its tube 102 is thus automatically centered with respect to the actuating means 132. This state is illustrated in FIG. 3*b* and in the expanded view of FIG. 4*a*.

Figure 4A:
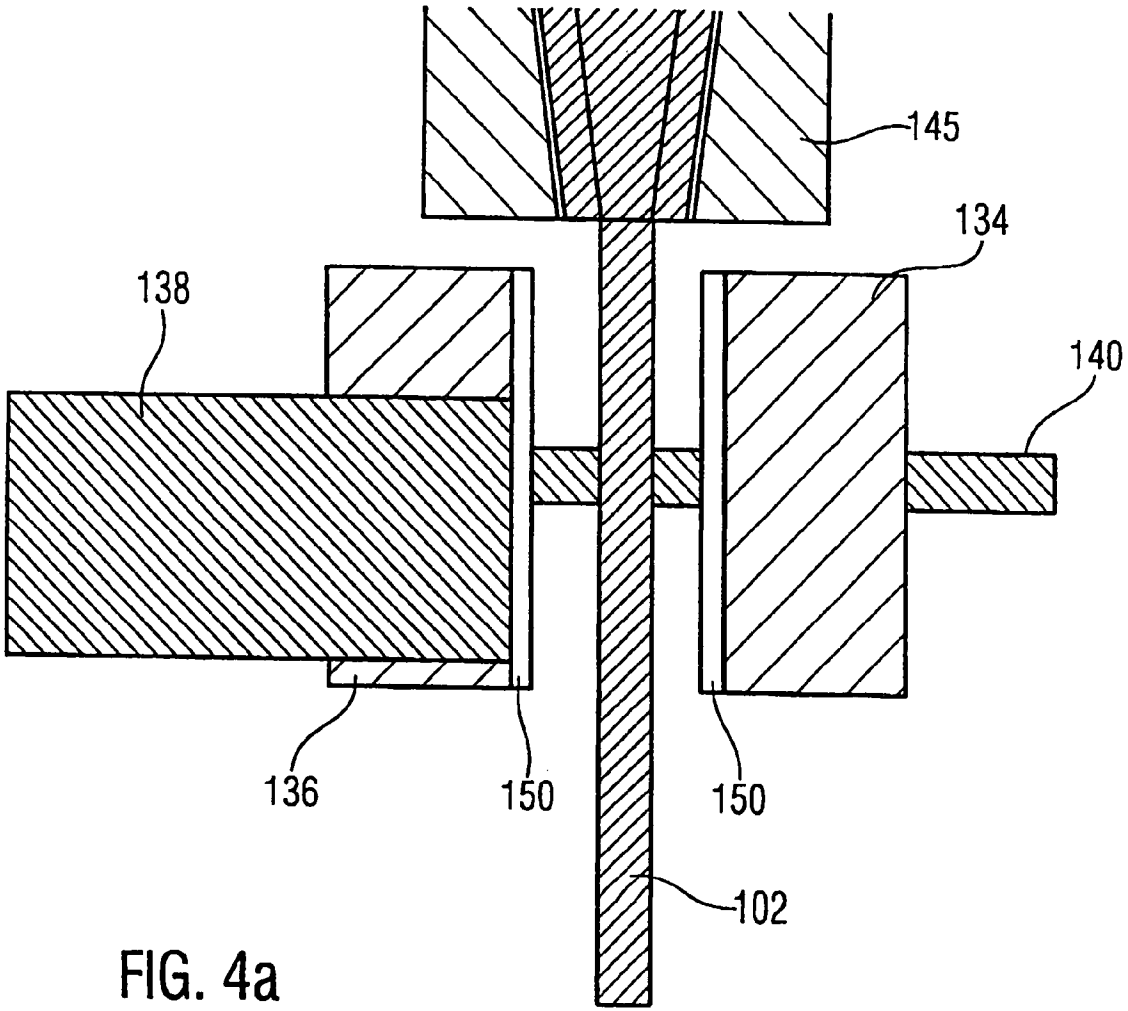
FIGS. 4*a* to 4*c* are schematic cross-sectional views for explaining various operating phases of the actuating means shown in FIGS. 3*a* and 3*b*.

After this centering of the pipette tip and thus of its elastic tube 102, the clamping jaws 134 and 136 are closed using the driving mechanism 143, so that the elastic tube 102 is fixed between them. As is best seen in FIGS. 3*b* and 4*a*, the clamping jaws 134 and 136 preferably comprise reliefs 150 for this purpose, which are adapted to the shape of the flexible tube 102 to support secure fixing of the flexible tube. As is further best to be seen from FIG. 3*b*, the clamping jaw 136 includes a through-hole through which the actuating member 138 extends. The recesses 150 may preferably be designed such that areas thereof abut the tube and surround the same so that the tube is securely fixed in the areas surrounding the actuating member 138.

Figure 4B:
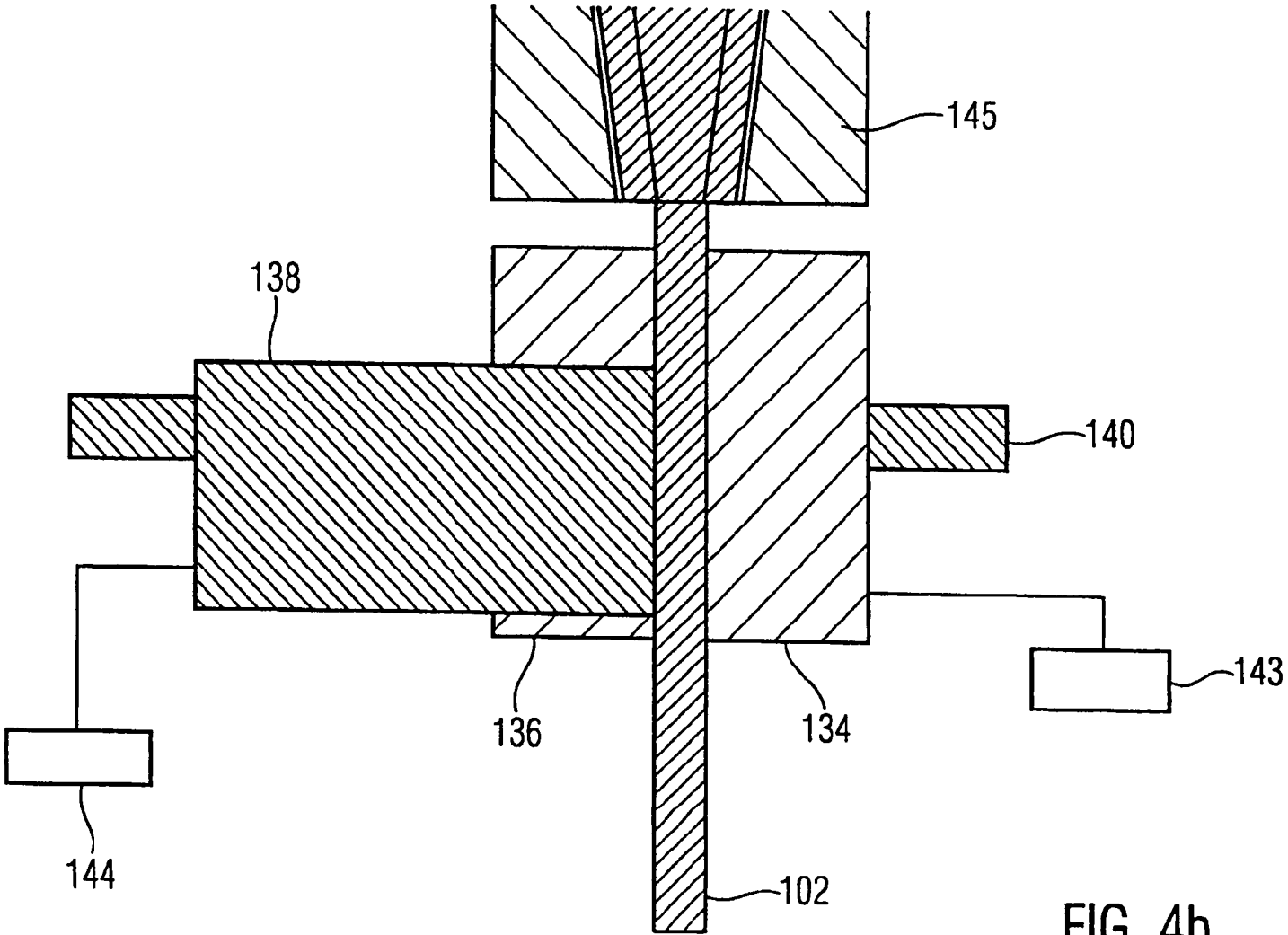
Figure 4C:
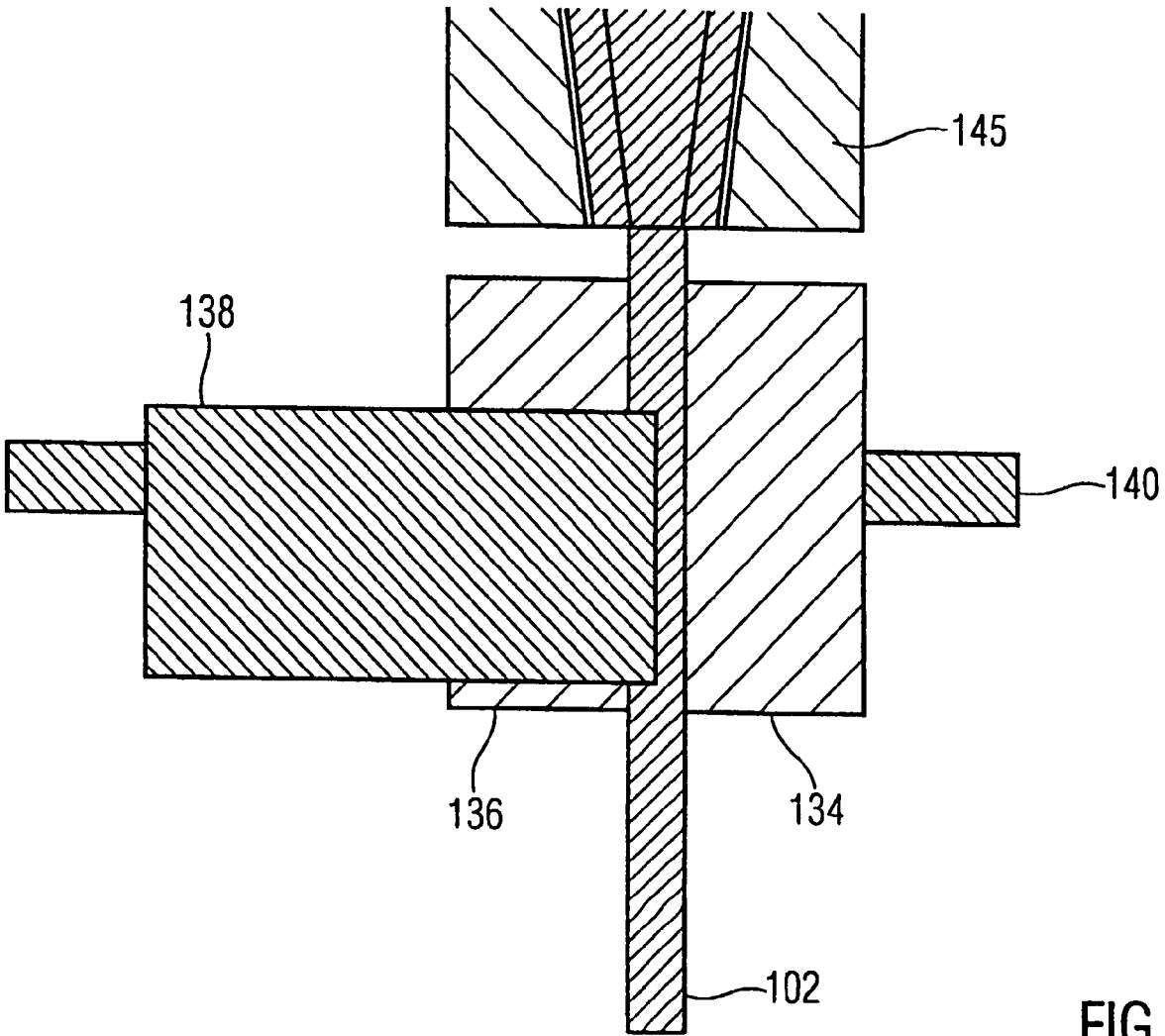
Figure 5:
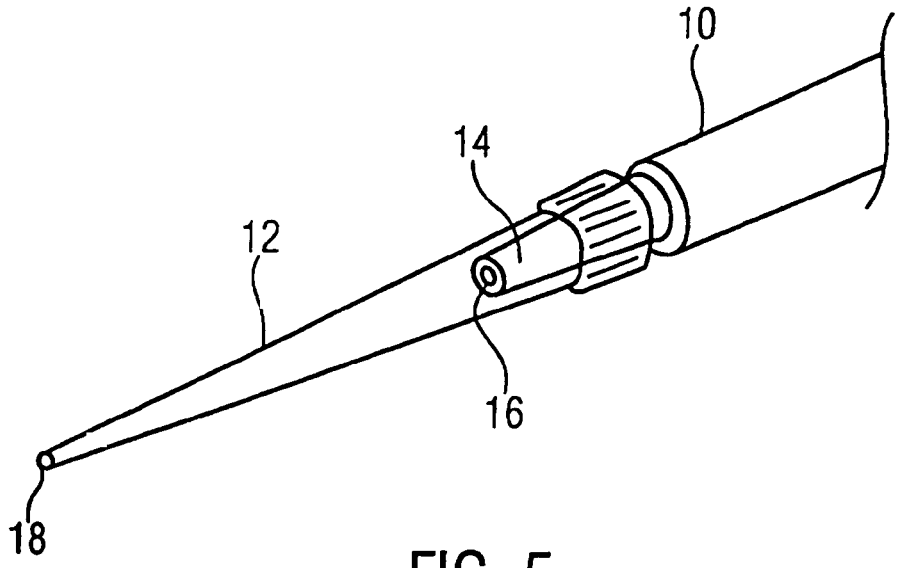
FIG. 5 schematically shows a conventional hand pipette.
Figure 6:
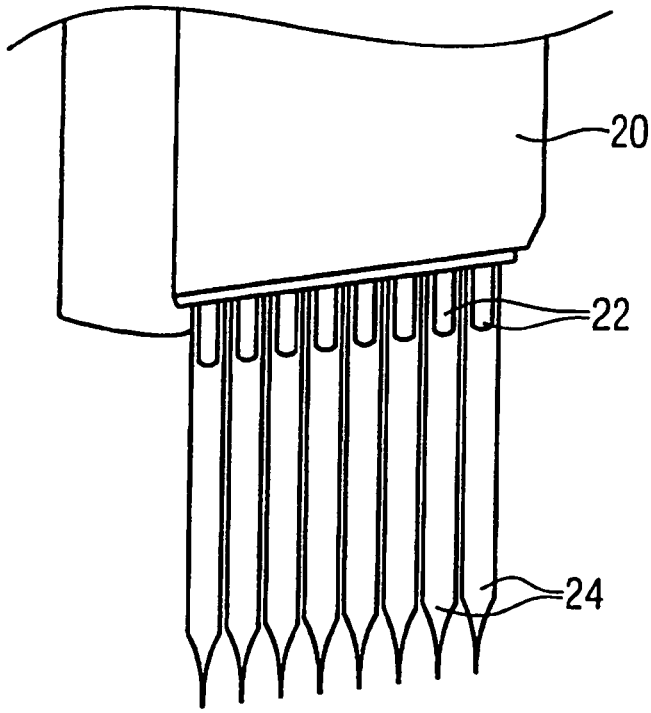
FIG. 6 schematically shows a moveable mount of a conventional automatic pipetting device.

The FIGS. 4*a* to 4*c* represent cross-sectional views with a sectional axis extending through the centers of the recesses 150 in the clamping jaws 134 and 136.

FIG. 4*b* shows the actuating device after the automatic closing of the clamping jaws 134 and 136. After closing the clamping jaws, the actuating member 138 is moved through the opening of the clamping jaw 136 provided for this purpose using the driving mechanism 144 to reduce the volume of the elastic tube 102 to thereby eject liquid as a free-flying droplet or as a free-flying jet from the orifice 112 of the elastic tube 102. Here, the clamping jaw 134 acts as a counterholding element. The phase in which the volume of the tube is reduced is shown in FIG. 4*c*. In the position shown in FIG. 4*b* the clamping jaw 136 and the actuating member 138 are preferably moved together, whereupon the actuating member is actuated into the position shown in FIG. 4*c*.

Figure 7A:
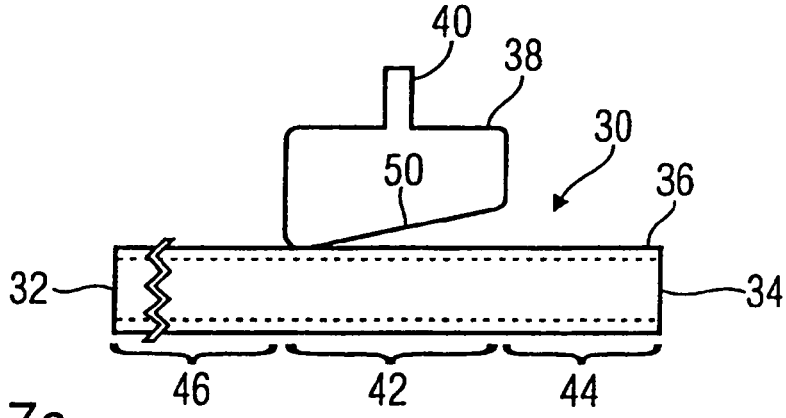
FIG. 7*a* to 7*c* show schematic representations for explaining a preferred inventive used dosing method.
Figure 7B:
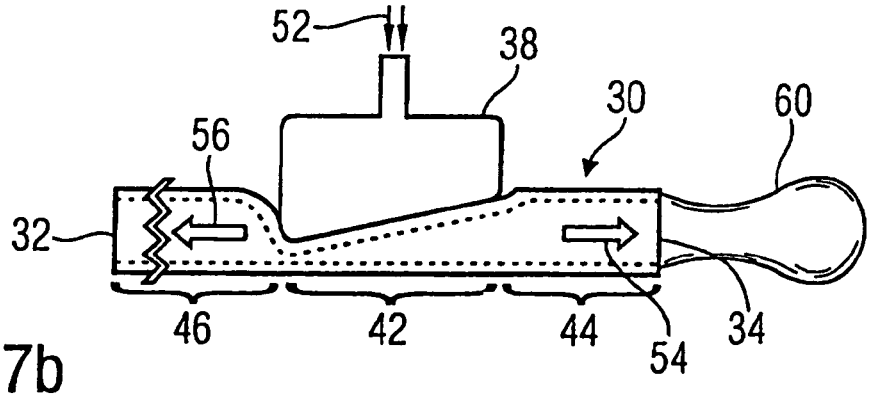
Figure 7C:
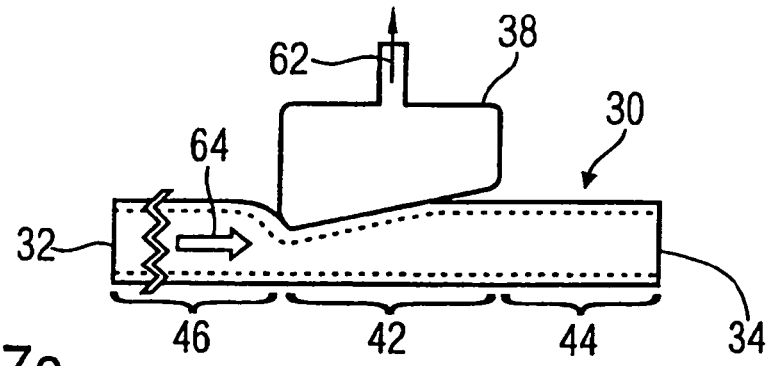

At this point, it is to be noted that, in this respect, FIGS. 3*a* to 4*c* are purely schematic, wherein the actuating member and the counterholding element may be formed in a suitable way to allow only partial squeezing of the tube or also complete squeezing of the tube. In this respect, it is further to be noted that the stroke of the driving means 144 of the actuating member 138 may be adjustable so that, by adjusting the stroke, different drop volumes may be ejected from the orifice 112 of the flexible tube 102. With respect to the ejecting method, see again the above description of FIGS. 7*a* to 7*c* and further the German application 10337484.1.

In the described embodiment, there is provided an auxiliary centering means 145 to center the pipette tip in the actuating means 145. It is apparent for those skilled in the art that such an auxiliary centering means is optional, for example if a sufficiently accurate positioning means is provided for the pipetting unit. The clamping jaws may, for example, be closed using an electromagnetic drive to fix the flexible tube. The actuating member may be driven electromagnetically or piezoelectrically to allow the desired dosing in the nanoliter range. If necessary, multiple dosing to various targets or into various vessels may optionally be performed. After the dosing process, the clamping jaws may be opened and the pipette tip may be removed by a conventional automatic pipetting device with a corresponding mechanism. The pipette tips may be placed in a waste box or in a storage carrier by means of an ejection mechanism (not shown) located in the automatic pipetting device. In the case of placement in a storage carrier, the dosing cycle may later be resumed by moving the pipette tip to the release position. As an alternative to the method described above, the pipette tip may also be put into a storage carrier immediately after aspirating and taken from the same only at a later time to perform a release of a volume of the aspirated liquid.

In preferred embodiments of the inventive pipetting device, the nozzle opening does not have any contact to the actuating means (driving unit) during centering, closing, dosing and opening, so that a carry-over of the liquid is prevented. The pipette tips may further be given from the pipetting unit (for example 120 in FIG. 2) to the actuating means including the fixing means, so that the liquid release may be done at another place than the intake, wherein the pipette tip does not have to be coupled to the pipette unit and/or the automatic pipetting device for the liquid release. Thus the automatic pipetting device and/or the pipetting unit may be used otherwise during the dosing by the actuating means for ejecting a liquid from the tube. By putting in series several driving units either driven by individual actuators or by a common actuator, it is very easy to achieve parallelization. In this respect, an actuating member driven by a corresponding driving mechanism may be designed to actuate several flexible tubes at the same time. On the other hand, several actuating members separate from each other may be provided, which may be actuated by a common driving unit or by separately controllable driving units.

As explained above, the present invention provides a novel pipetting device and/or components for a pipetting device. In this respect, a conventional automatic pipetting device may be used together with inventive pipette tips and an inventive actuating means for such pipette tips.

Alternatively, it is also possible to use the inventive pipette tips without the inventive actuating means. In this case, the dispensing may be done by conventional methods, such as pressure-driven in air cushion pipettes.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A pipetting device comprising:

a coupling unit for coupling to a pipette tip comprising a first end with a fluid opening and a second end having a pipe elastic in the radial direction with an orifice, wherein the orifice and the fluid opening are in fluid connection, and wherein the first end is designed to be coupled to the coupling unit, the elastic pipe having such dimensions that the elastic pipe itself behaves substantially rigid with respect to bending along the pipe axis, but is flexible and elastic with respect to radial deformations;

a first actuating unit for generating a negative pressure at the fluid opening at the first end of the pipette tip to suck in liquid through the orifice of the elastic pipe in the axial direction;

a second actuating unit for changing the volume of a portion of the pipe elastic in the radial direction in time to thereby eject liquid as droplets or as a free-flying jet from the orifice of the elastic pipe in the axial direction; and the pipe elastic in the radial direction providing a substantially constant inner cross-section up to the orifice.

2. The pipetting device of claim 1, wherein the second actuating unit comprises an actuating member and a counterholding element, wherein the actuating member may be actuated to change the volume of the portion of the pipe elastic in the radial direction by a movement in the direction of the counterholding element.

3. The pipetting device of claim 2, further comprising a controller designed to control the distance that the actuating member moves to thereby adjust the volume of a liquid ejected from the orifice.

4. The pipetting device of claim 2, wherein the counterholding element is a first clamping jaw of a fixing unit, wherein the fixing unit further comprises a second clamping jaw, wherein the first and the second clamping jaw are designed to fix the pipe elastic in the radial direction.

5. The pipetting device of claim 4, wherein the first and the second clamping jaw comprise concave surface portions adapted to the convex external shape of the pipe elastic in the radial direction to receive and fix the pipe elastic in the radial direction.

6. The pipetting device of claim 1, further comprising a positioning unit designed to position the pipette tip in a first position for sucking in liquid and to position it in a second position for ejecting liquid.

7. The pipetting device of claim 6, wherein the pipette tip comprises a rigid portion to which the pipe elastic in the radial direction is attached, wherein the positioning unit further comprises a guiding unit having contours adapted to the contours of the rigid portion of the pipette tip to support positioning of the pipette tip with respect to the second actuating unit.

8. The pipetting device of claim 1, wherein the pipe elastic in the radial direction and the second actuating unit are designed to eject a liquid volume in the range between 0.1 nL and 100 nL by changing the volume.

9. A pipette tip actuating device for a pipetting device including a pipette tip having a first end with a fluid opening and a second end, wherein the second end comprises a pipe elastic in the radial direction having an orifice, wherein the fluid opening and the orifice are in fluid connection and the elastic pipe has such dimensions that the elastic pipe itself behaves substantially rigid with respect to bending along the pipe axis, but is flexible and elastic with respect to radial deformations, the pipe elastic in the radial direction providing a substantially constant inner cross-section up to the orifice, comprising:

a fixing unit having a first state in which the pipe elastic in the radial direction is fixed in a predetermined position, and a second state in which the pipe elastic in the radial direction is not fixed;

a fixing unit driver for changing the state of the fixing unit; and an actuating unit for changing the volume of a portion of the pipe elastic in the radial direction in time to thereby eject liquid as droplets or as a free-flying jet from the orifice of the elastic pipe in the axial direction, when the fixing unit is in the first state.

10. The pipette tip actuating device of claim 9, further comprising a guiding unit having contours adapted to the contours of a rigid portion of the pipette tip to support positioning of the pipette tip in the predetermined position by engaging the rigid portion of the pipette tip.

11. The pipette tip actuating device of claim 9, wherein the fixing unit comprises two clamping jaws to clamp the pipe elastic in the radial direction, wherein the fixing unit driver is designed to move the clamping jaws relative to each other.

12. The pipette tip actuating device of claim 11, wherein a clamping jaw serves as counterholding element for the actuating device.

* * * * *